United States Patent [19]

Moss

[11] 4,124,150

[45] *Nov. 7, 1978

[54] SELF-CLOSING CONTAINER OUTLET

[76] Inventor: Norman W. Moss, 215 S. 11th Ave. Suite D, Yakima, Wash. 98902

* Notice: The portion of the term of this patent subsequent to Sep. 7, 1994, has been disclaimed.

[21] Appl. No.: 602,696

[22] Filed: Aug. 18, 1975

Related U.S. Application Data

[63] Continuation of Ser. No. 445,198, Feb. 25, 1974, abandoned.

[51] Int. Cl.[2] ..... B65D 37/00

[52] U.S. Cl. ..... 222/494

[58] Field of Search ..... 222/92, 490, 494; 137/525, 1

[56] References Cited

U.S. PATENT DOCUMENTS

| | | | |
|---|---|---|---|
| 2,526,629 | 10/1950 | Bourke | 137/525.1 X |
| 2,550,132 | 4/1951 | Woods | 222/490 |
| 3,565,106 | 2/1971 | Baumbach | 137/513.3 |
| 3,566,964 | 3/1971 | Livingston | 166/224 |

*Primary Examiner*—Stanley H. Tollberg
*Assistant Examiner*—Norman L. Stack, Jr.

[57] ABSTRACT

The self-closing cap for resilient dispenser-containers to be mounted to the aperture of the neck of the dispenser, comprises a channel member having a flat member issuing from one side of the aperture, parallel to the rectilinear axis of the neck; a reed being a stiffly flexible member fastened parallel to the channel member on the aperture, the reed being mounted to be urged at its uppermost terminal end contiguously with the upper portion of the interior side of the channel member; and means for enclosing the respective sideward edges of the channel member and the reed. A further primary embodiment of the self-closing cap for resilient dispenser-containers to be mounted at the aperture of the neck of the dispenser comprises a pair of reeds mounted parallel to opposing sides of the aperture, the reeds being fabricated of a suitable stiffly flexible material, and the reeds being mounted to be urged together to contiguously contact each other at their upper portions; and means for enclosing the sideward edges of said reeds.

9 Claims, 6 Drawing Figures

SELF-CLOSING CONTAINER OUTLET

REFERENCE TO OTHER APPLICATIONS

This application is a continuation of application Ser. No. 445,198, filed Feb. 25, 1974, now abandoned.

FIELD OF INVENTION

The present invention relates to dispensers, and more particularly to a self-closing cap for resilient-type dispenser-containers.

BACKGROUND OF INVENTION

It has been a long-felt need with respect to resilient-type dispensers, such as paste or chemical jell tube or squeeze-bottle-type dispensers, that there be provided means for assuring closure of the dispenser after use. Loss of material by spoilage or deteriation due to exposure is well-known and well-understood. It has also been found that in such dispensers, particularly those used as direct applicators, such as with medicine, it is inconvenient to open then replace a separate cap to stop the flow of material and to protect contents.

Accordingly, it is an object of the present invention to provide a self-closing cap which operates in response to pressure of material from the dispenser-container.

It is a further object of this invention to provide a self-closing cap which may be of simple construction.

It is another object of this invention to provide a self-closing cap which may be used as an applicator or spreader for material dispensed.

These and other objects shall become apparent from the description following, it being understood that modifications may be made without affecting the teachings of the invention here set out.

SUMMARY OF THE INVENTION

The self-closing cap for resilient dispenser-containers to be mounted to the aperture of the neck of the dispenser comprises a channel member having a flat member issuing from one side of the aperture, parallel to the rectilinear axis of the neck; a reed being a stiffly flexible member fastened parallel to the channel member on the aperture, the reed being mounted to be urged at its uppermost terminal end contiguously with the upper portion of the interior side of the channel member; and means for enclosing the respective sideward edges of the channel member and the reed. A further primary embodiment of the self-closing cap for resilient dispenser-containers to be mounted at the aperture of the neck of the dispenser comprises a pair of reeds mounted parallel to opposing sides of the aperture, the reeds being fabricated of a suitable stiffly flexible material, and the reeds being mounted to be urged together to contiguously contact each other at their upper portions; and means for enclosing the sideward edges of said reeds.

A more thorough and comprehensive understanding may be had from the detailed description of the preferred embodiment when read in connection with the drawings forming a part of this specification.

DETAILED DESCRIPTION OF THE PREFERRED EMBODIMENT

Figure 1:
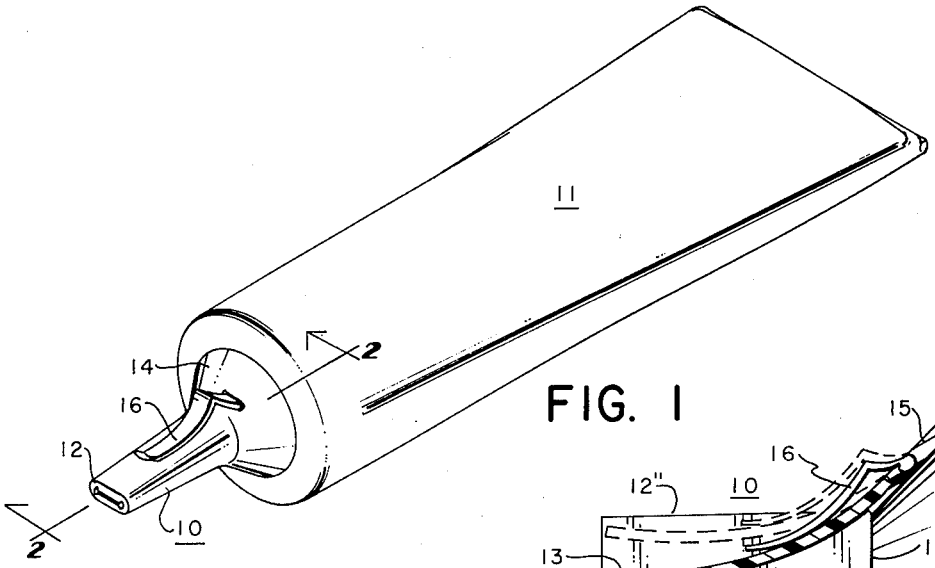
FIG. 1 is a perspective view of the self-closing cap of this invention shown in the environment of a resilient container, such as a paste tube.

Referring now to the drawings and more particularly to the FIG. 1, the self-closing cap of this invention is shown to advantage and generally identified by the numeral 10. The cap 10 is intended to be associated with a container having resilient walls, such as a commonly known tube-type dispenser 11, which is operable to urge fluid, jells, or paste materials by pressure exerted on the side walls. It is also to be recognized that extruder-type dispensers having barrel-like container walls and a plunger may be used in conjunction with the present cap 10.

Figure 2:
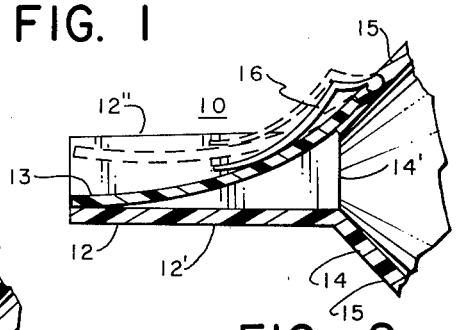
FIG. 2 is a cross-sectional view taken substantially along the lines 2—2 of the FIG. 1 showing the self-closing cap of this invention.

Referring to the FIG. 2, the self-closing cap 10 comprises a channel member 12 and a reed 13. The channel member 12 issues rectilinearly outward from the neck 14 of the dispenser 10. The channel member 12 may have a substantially square-corner U-shaped transverse cross-section, wherein the rectilinear conterline of the neck 14 is congruent with the epicenter of the member 12. The aperture 14' of the neck 14 is congruent with the cavity formed by the channel member 12. The volume of material dispensed through the aperture 14' may be predeterminately controlled by reducing the neck 14 by shoulders 15 to the aperture 14'. The reed 13 is a stiffly flexible member made of a suitable material, such as polymeric strip or metal sheet, and is fastened at its base parallel to the side opposite the base portion 12' of the member 12 to contact the upper portions of the interior flat surface of the base 12'. The reed 13 is sufficiently wide at its uppermost portion to move between the sidewalls or legs 12'' of the member 12 without permitting material to escape therefrom. Referring to the FIGS. 1 and 2, in operation pressure may be applied to the dispenser 11 causing pressure on the materials carried therein. This pressure on the material causes the reed 13 to be urged away from the base 12' of the channel member 12, thus permitting passage of material. When the dispenser 11 is released, the urging force of the reed 13 forces material trapped between the channel member 12 and the reed 13 to be forced back into the dispenser and for the upper terminal edge of the reed 13 to be closed adjacent the upper portion of the base 12'. It is to be understood that additional urging force on the reed 13 may be supplied by an urging spring 16. It also may be seen that the upper terminal edges of the channel member 12 and the reed 13 may be used as a convenient spreading device for applying material.

Figure 3:
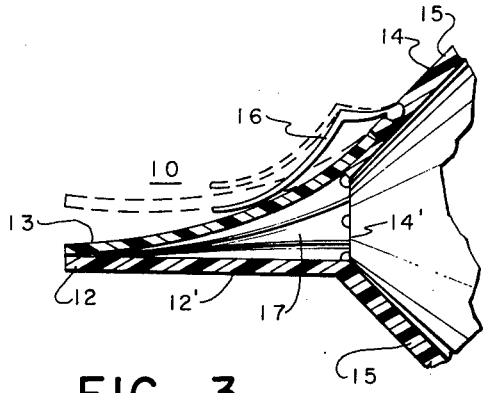
FIG. 3 is a cross-sectional view taken substantially along the lines 2—2 of the FIG. 1 showing a further embodiment of the self-closing cap.

Referring to the FIG. 3, a further embodiment of the self-closing cap 10 comprises a channel member 12, a reed 13, and flexible walls 17. In this embodiment, the channel member 12 comprises a substantially flat member 12' which issues outwardly rectilinear from one side of the aperture 14'. The reed 13, like the reed 13 above, is fastened on the side opposite the channel member 12 of the aperture 14' of the neck 14, and is operable to contiguously contact the upper portions of the flat surface of the channel member 12'. The flexible walls 17 are fastened to each of the sideward edges of the member 12' and the reed 13. A resilient film may be used to fabricate the flexible walls 17; and the walls may be fabricated in a pleated, accordion-like structure. Operation of the self-closing cap 10 of the further embodiment is substantially the same as that set out above. It may be seen that, between the embodiment of the self-closing cap 10 above and the present further embodiment, the latter is operable to enclose material carried and conducted therein.

Figure 4:
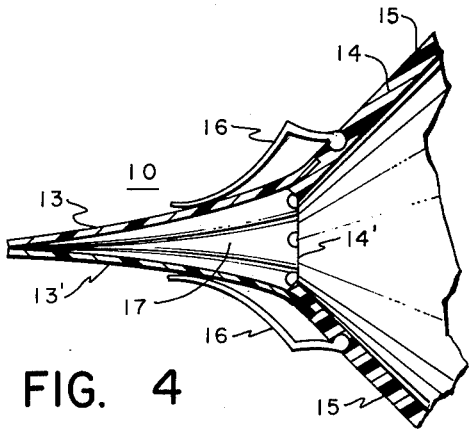
FIG. 4 is a cross-sectional view taken substantially along the lines 2—2 of the FIG. 1 showing a still further embodiment of the self-closing cap.

Referring to the FIG. 4, a still further embodiment of the self-closing cap 10 includes a pair of reeds 13 and 13', and flexible walls 17. The reeds 13 and 13' of this further embodiment may be fabricated of the same type of material as set out above. The reeds 13 and 13' are fastened parallel at opposite sides of the aperture 14' of the neck 14 with their forwardmost terminal ends urged contiguously together in a similar structure to the channel member 12' and the reed 13 set out above. The flexible sidewalls 17 are fastened to the respective sideward edges of the reeds 13 and 13'. As above, additional urging force may be provided by a spring 16 on each of the reeds 13 and 13'. Also as above, the uppermost terminal ends of the reeds 13 and 13' may be used as a spreader for applying material.

Figure 5:
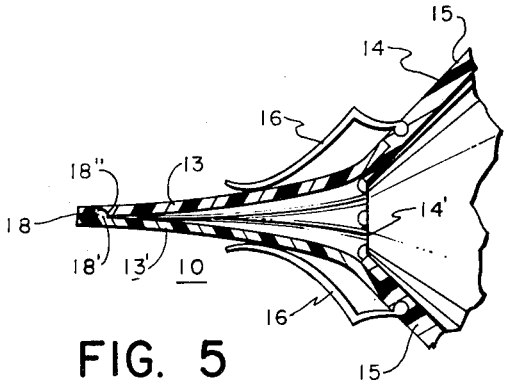
FIG. 5 is a cross-sectional view drawn to a larger scale showing the self-closing cap including a snap-lock closure means.

Referring to the FIG. 5, a snap lock 18 may be disposed distally and parallel from the uppermost terminal ends of the reeds 13 and 13' as a security closure means. The snap lock 18 may comprise a convexbead 18' molded on teh interior side of one of the reeds 13 and the opposing reed 13' may be provided with a complementary groove 18''. It is to be understood that the snap lock 18 may be provided in similar fashion between the rigid channel member 12 and the reed 13 in the same manner as the reeds 13 and 13' here disclosed.

Figure 6:
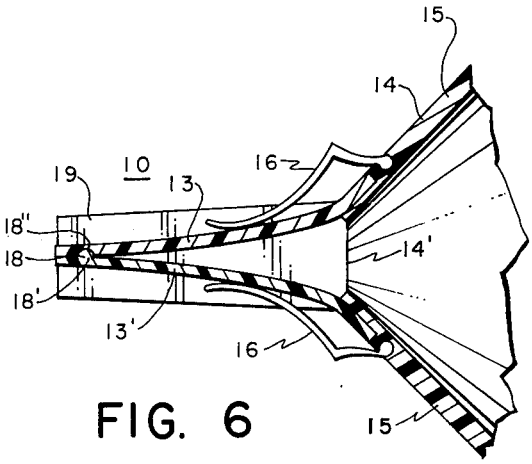
FIG. 6 is a cross-sectional view of a further embodiment of the self-closing cap.

Referring to the FIG. 6, another further embodiment includes a pair of reeds 13 and 13' mounted substantially as set out above and a pair of sidewalls 19 which issue upwardly from the aperture 14' at the sides of the reeds 13 and 13'. Operation of this further embodiment is substantially the same as set out above, with respect to the double-reed-type self-closing cap 10. The sidewalls 19 provide a rigid channeling means which may protect the reeds 13 and 13' from high-impact forces and may be used a a spreader. It is to be understood that all embodiments have included the urging means 16, but that any of a number of equivalents may be employed to properly urge the reed 13 to the closed position including suitably configuring the reed 13 itself.

Having thus described in detail a preferred apparatus which embodies the concepts and principles of the invention and which accomplishes the various objects purposes and aims thereof, it is to be appreciated and will be apparent to those skilled in the art that many physical changes could be made in the apparatus without altering the inventive concepts and principles embodied therein. Hence, it is intended that the scope of the invention be limited only to the extent indicated in the appended claims.

I claim:

1. A self-closing container outlet for resilient containers to be mounted to the aperture of the neck of said dispenser, comprising:

a channel member having a flat member issuing from one side of said aperture, parallel to the rectilinear axis of said neck;

a reed being a stiffly flexible semi-rigid strip fastened to each side of said channel member on said aperture, said reed being mounted to be urged at its uppermost terminal end into contiguous contact with the upper portion of the interior side of said channel member; and means for shielding the respective sideward edges of said channel member and said reed, said means for enclosing said channel member and said reed including a pair of sidewalls issuing from said channel member and from said aperture in a square-cornered U-shaped-like configuration.

2. The apparatus of claim 1 wherein an urging spring is provided on said reed to provide additional urging force on said reed toward said channel member.

3. The apparatus of claim 1 including a snap lock fastened distally from the uppermost terminal edges of said channel member and said reed.

4. A self-closing container outlet for resilient containers to be mounted to the aperture of the neck of said dispenser, comprising:

a channel member having a flat member issuing from one side of said aperture, parallel to the rectilinear axis of said neck;

a reed being a stiffly flexible semi-rigid strip fastened to each side of said channel member on said aperture, said reed being mounted to be urged at its uppermost terminal end into contiguous contact with the upper portion of the interior side of said channel member; and means for shielding the respective sideward edges of said channel member and said reed said means for enclosing said channel member and said reed including flexible walls fastened to the respective sideward edges of said channel member and said reed.

5. A self-closing cap for resilient dispenser-containers to be mounted at the aperture of the neck of said dispenser, comprising:

a pair of reeds mounted parallel to opposing sides of said aperture, said reeds being fabricated of a suitable stiffly flexible material, and said reeds being mounted to be urged together to contiguously contact each other at their upper portions; and means for enclosing the sideward edges of said reeds, said means for enclosing said channel member and said reed including flexible walls fastened to the respective sideward edges of said channel member and said reed.

6. The apparatus of claim 5 wherein said means for enclosing said channel member and said reed includes flexible walls fastened to the respective sideward edges of said channel member and said reed.

7. A self-closing cap for resilient dispenser-containers to be mounted at the aperture of the neck of said dispenser comprising:

a pair of reeds mounted parallel to opposing sides of said sperture, said reeds being fabricated of a suitable stiffly flexible material, and said reeds being mounted to be urged together to contiguously contact each other at their upper portions; and means for enclosing the sideward edges of said reeds said means for enclosing said channel member and said reed including flexible walls fastened to the respective sideward edges of said channel member and said reed.

8. The apparatus of claim 7 including an urging spring for providing additional urging force to urge the uppermost terminal edges of said reeds together.

9. The apparatus of claim 7 including a snap lock being disposed distally from the uppermost terminal edge on the interior terminal edge.

* * * * *

UNITED STATES PATENT AND TRADEMARK OFFICE

CERTIFICATE OF CORRECTION

PATENT NO. : 4,124,150

DATED : November 7, 1978

INVENTOR(S) : Norman W. Moss

It is certified that error appears in the above-identified patent and that said Letters Patent are hereby corrected as shown below:

Column 1, line 19, "deteriation" should be —deterioration—.

Column 3, line 35, "teh" should be —the—.

Claim 1

Column 3, line 68, delete "dispenser" and insert —container— therefor.

Column 4, line 10, delete "shielding" and insert —enclosing— therefor.

Claim 4

Column 4, line 36, after "said reed" insert a comma —,—.

Claim 5

Column 4, line 50, delete "said channel member and".

line 51, change "reed" to —reeds—.

line 52, delete "said channel member".

line 53, delete "and", and change "reed" to —reeds—.

Claim 6

Column 4, line 55, delete "said channel member and" and change "reed" to —reeds—.

line 57, delete "said channel member and", and change "reed" to —reeds—.

line 62, "sperture" should be —aperture—.

UNITED STATES PATENT AND TRADEMARK OFFICE

CERTIFICATE OF CORRECTION

PATENT NO. : 4,124,150

DATED : November 7, 1978

INVENTOR(S) : Norman W. Moss

It is certified that error appears in the above-identified patent and that said Letters Patent are hereby corrected as shown below:

Claim 7

Column 4, line 66, after "reeds" add a comma —,—.

line 67, delete "said channel member and".

line 68, change "reed" to —reeds—.

Column 5, line 1, delete "said channel member".

line 2, delete "and" and change "reed" to —reeds—.

Signed and Sealed this

*Third* Day of *July 1979*

[SEAL]

*Attest:*

*Attesting Officer*

LUTRELLE F. PARKER

*Acting Commissioner of Patents and Trademarks*